US005209564A

United States Patent [19]

Manci et al.

[11] Patent Number: 5,209,564

[45] Date of Patent: May 11, 1993

[54] VIBRATOR

[75] Inventors: Lewis H. Manci, Spring; Mark H. Neundorfer, Houston, both of Tex.

[73] Assignee: National Air Vibrator Company, Houston, Tex.

[21] Appl. No.: 822,679

[22] Filed: Jan. 21, 1992

[51] Int. Cl.[5] ..... B01F 11/00

[52] U.S. Cl. ..... 366/124; 91/234; 92/162 P

[58] Field of Search ..... 366/124; 91/934; 92/162, 248

[56] References Cited

U.S. PATENT DOCUMENTS

| | | | |
|---|---|---|---|
| 786,050 | 3/1905 | Richwood | 366/124 X |
| 1,205,140 | 11/1916 | App | 91/234 |
| 1,245,603 | 11/1917 | Lewis . | |
| 1,403,583 | 1/1922 | Adams . | |
| 1,428,630 | 9/1922 | Hammond | 366/124 |
| 1,447,694 | 3/1923 | Stoney | 366/124 |
| 1,504,976 | 8/1924 | Ringle | 91/234 |
| 2,561,577 | 7/1951 | Knudsen | 91/234 |
| 2,907,304 | 10/1959 | Macks | 121/38 |
| 3,205,787 | 9/1965 | Volkmann | 91/399 |
| 3,232,178 | 2/1966 | Sandvig | 91/317 |
| 3,511,137 | 5/1970 | Smith | 92/171 |
| 3,600,046 | 8/1971 | Redmon | 384/12 |
| 3,659,504 | 5/1972 | Zurcher | 92/162 |
| 3,726,508 | 4/1973 | Varnello et al. | 366/124 X |
| 3,779,672 | 12/1973 | Schroeder | 92/248 |
| 4,191,093 | 3/1980 | Compton | 91/234 |
| 4,550,646 | 11/1985 | Miller | 92/128 |

FOREIGN PATENT DOCUMENTS

| | | | |
|---|---|---|---|
| 391114 | 10/1908 | France | 91/234 |
| 1138621 | 6/1957 | France | 91/234 |
| 561042 | 6/1975 | U.S.S.R. | 92/162 R |
| 1514913 | 6/1978 | United Kingdom . | |
| 2063379 | 6/1981 | United Kingdom . | |

*Primary Examiner*—Philip R. Coe
*Assistant Examiner*—Randall E. Chin
*Attorney, Agent, or Firm*—Michael Sand Co.

[57] ABSTRACT

A pneumatic vibrator is disclosed including a tubular housing having closed ends, an inlet port in the housing through which a fluid, such as air can flow into the housing, and a free-floating piston in the housing having two passageways through which the pressurized air entering the housing through the inlet port flows to act alternately against opposite ends of the piston and cause the piston to reciprocate in the housing. Exhaust ports are located in the housing through which the air ahead of the moving piston is exhausted from the housing. A plurality of relatively small openings is located in the housing through which pressurized air can flow into the housing and provide a fluid bearing between the piston and the housing, and means are provided to supply the inlet port opening with air under pressure.

10 Claims, 3 Drawing Sheets

VIBRATOR

CROSS-REFERENCE TO RELATED APPLICATIONS

This is a refiling of earlier-filed U.S. Ser. No. 06/940,737 filed Dec. 11, 1986, now abandoned, and earlier-filed pending U.S. Ser. No. 07/562,022 filed Aug. 2, 1990, to be abandoned in favor of this continuation-in-part patent application.

BACKGROUND OF THE INVENTION

1. Technical Field

This invention relates to vibrators generally and, in particular, to pneumatic vibrators in which a free piston is reciprocated by air pressure acting alternately on the ends of the piston. In the subject type of air vibrators, no external controls are required for reciprocal movement of the free piston. Vibrators are used extensively as flow aid devices for bulk material handling, and may be used as core samplers, drives for feeders, screening machines, electrostatic precipitator rapping, galvanizing, and for similar purposes.

2. Background information

Such vibrators include a cylindrical housing having inlet and exhaust ports and a free piston with a passage that connects the inlet port to the portion of the housing between one end of the piston and the end of the housing when the piston is near that end and another passage that similarly connects the portion of the housing at the other end. The piston is reciprocated by pressurized air as the passages in the piston are connected alternately to the inlet in the housing. As the piston reciprocates, it creates vibrations in the housing and in whatever structure the housing is connected.

The piston may carry seals such as piston rings. Other types of vibrators depend instead on a close fit between the piston and the bore of the housing to provide a sufficient restriction to the flow of air between the piston and the cylinder for the proper operation of the vibrator. With time, however, wear occurs between the piston and the bore of the housing such that the clearance between the piston and housing increases, eventually reaching the point where the vibrator does not operate satisfactorily.

In the use of prior art air vibrators, their operating life is usually measured in short periods of time ranging from 2 to 3 months at most. Frequently, abrasive dust is sucked into their exhaust ports due to a temporary vacuum effect when the vibrators are cycled off and pressurized air delivery is discontinued. This condition causes excessive wear internally of the vibrators such that their reciprocation frequently does not start when pressurized air delivery is turned on. In addition, lubrication of the piston must be maintained which is difficult in severe high-temperature environments. Elliptical wear of the facing piston and housing surfaces is usually observed which shortens vibrator life. Also the use of lubricants is highly undesirable where the vibrators are used in areas where sources of fires or explosions must be avoided.

Restoration of vibrators is possible, but only by remachining the cylinder housing and installing a new piston machined to allowable tolerances for the required clearance. This process requires dismounting, shipment to a qualified repair facility, disassembly of the vibrator, machining, reassembly, shipment back to the user, and remounting. In many applications, this procedure is cost prohibitive. In addition, a restored vibrator still experiences the same wear problems. Normally it is uneconomical to rebuild the vibrator a second time.

Several variations have been developed as improvements over the general piston vibrator design. One such design incorporates a removable inner sleeve, which eliminates the need for remachining the housing during the restoration process, thereby permitting the housing to be used indefinitely. These sleeves are designed in such a way that they are inserted into the housing in a close fitting relationship with the housing and must be properly oriented to properly align the inlet and outlet ports. These design limitations necessitate restoration be performed by a qualified repair facility.

Other variations over the general piston vibrator design are offered to improve wear characteristics. These include coating the sleeve or housing with special low-friction type coatings, case hardening the sleeve or housing, and inserting lubrication fluid into the air line. Many types of low-friction coatings can be used, but the trade-off between lower friction at higher costs makes most low-friction coatings economically unfeasible. Case hardening does improve wear characteristics, but the continuous metal-to-metal contact eventually causes failure. Lubricators offer a reasonably inexpensive method for reducing friction, but the periodic maintenance required to insure the vibrators receive adequate lubrication is undesirable. Also, oil-laden air which can form explosive mixtures must be avoided in certain applications such as in power plant operations.

SUMMARY OF THE INVENTION

It is an object of this invention to provide a pneumatic vibrator that has a fluid bearing or cushion between the piston and housing to greatly reduce the friction between the piston and the housing.

It is a further object of this invention to provide a pneumatic vibrator that includes a housing having inner and outer walls to provide an annular chamber from which fluid is supplied to operate the vibrator and provide the fluid bearing.

It is another object of this invention to provide a pneumatic vibrator of this type that includes a housing having inner and outer spaced-apart cylindrical members which form an annular chamber between the members from which fluid is supplied to the interior of the housing to reciprocate the piston and to provide a fluid bearing between the piston and the inner member of the housing.

It is another object of this invention to provide a pneumatic vibrator of this type that includes a housing having an outer cylindrical member and an inner annular member that can be removed when worn and which forms with the outer member an annular chamber from which operating fluid and bearing fluid is supplied to the interior of the housing. The vibrator is operated from a single pressurized air source with no external controlling devices. Air from the main inlet port is utilized to provide the fluid bearing and also provide the energy-creating reciprocal motion of the free piston.

These and other objects, advantages, and features of this invention will be apparent to those skilled in the art from a consideration of the specification including the attached claims and appended drawings.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

In the following detailed description of the invention, the fluid used to operate the vibrator is preferably air.

Figure 1:
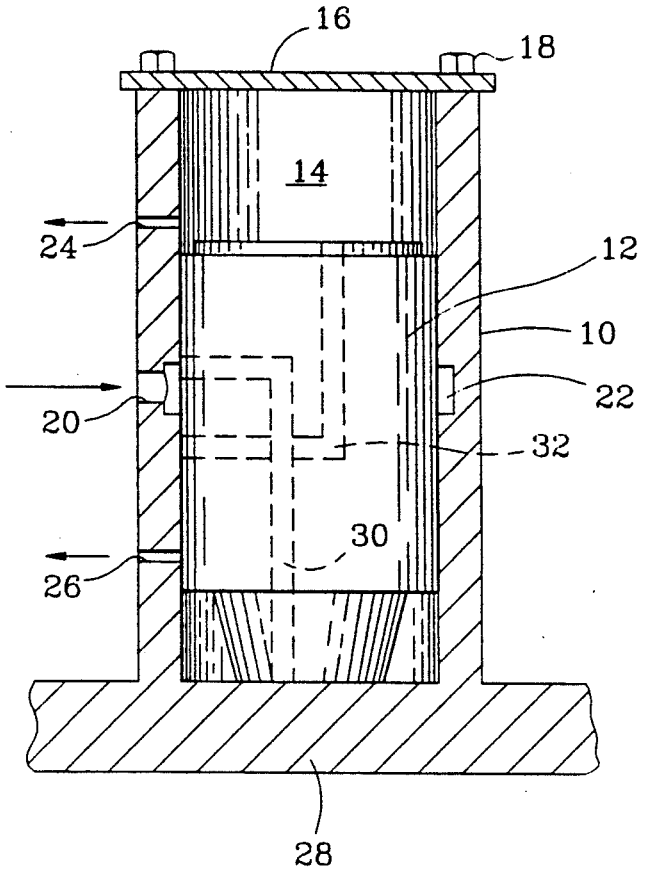
FIG. 1 (PRIOR ART)
FIG. 1 is a cross-sectional view of a typical prior art vibrator of the type to which this invention relates.

The prior art vibrator shown in FIG. 1 includes cylindrical housing 10 and free piston 12 located in cylindrical opening or bore 14 of the housing. The upper end of the housing is closed by end plate 16 that is attached to the housing in any convenient manner such as by machine screws or bolts 18 which engage tapped holes (not shown) in the upper end of the wall of housing 10. Inlet port 20 is located about midway between the ends of the housing and connects to annular groove 22. Outlet ports 24 and 26 are located on opposite sides of the inlet between the inlet and the ends of the housing. The lower end of the housing is closed by plate 28 and is shown in the drawing (FIG. 1) as an integral part of housing 10. In practice, the housing will probably be attached to member 28, which is a portion of the structure that is being vibrated, by a mounting flange connected to the member by bolts to allow the vibrator to be removed for replacement and repair, if desired.

Piston 12 is provided with two passageways to connect pressurized air coming in through inlet 20 to the bore of the housing between the end of the housing and the end of the piston, depending upon the position of the piston in the bore. For example, when the piston is in the lower end of the housing, passageway 30, shown in dotted lines connects inlet air entering through inlet 20 to the portion of the bore between the lower end of the piston and housing lower closure member 28 so that the pressure of the incoming air will move piston 12 upwardly toward upper end closure member 16. As the piston moves upwardly, the flow of air through passageway 30 will be effectively cut off due to the small clearance between the bore of the housing and the outside diameter of the piston and the momentum of the piston moving upwardly will be such that it will continue moving upwardly until passageway 32 is positioned adjacent groove 22 and inlet air is supplied to the upper end of the bore through passageway 32 causing the piston to move downwardly again. This valving arrangement is automatic so that once pressurized air is supplied to the interior of bore 14, the piston will automatically reciprocate at a speed depending, among other things, upon the air pressure and the weight of the piston.

As the piston reciprocates, vibrations will be induced in bottom plate 28 and in whatever is attached to or a part of the plate. The piston may reciprocate without striking either end closure member or it may strike one or both. The bottom plate 28 may be attached to the structure to be vibrated or the entire vibrator may also be attached to another structure to be vibrated such as a grain bin, fly ash bin, or dry cement bin, for example, to ensure uniform delivery therefrom.

The outlet ports 24 and 26 exhaust the air on opposite sides of the piston when air is not being supplied to the portion of the bore of the housing connected to a particular outlet port. For example, when air is supplied through passageway 30 to the lower end of the piston, when it is in a position shown in FIG. 1, outlet port 24 will have reduced the pressure in the upper end of the bore to substantially atmospheric pressure so that it will not resist the upward movement of the piston. In the same manner, when the piston has reached the upper limit of its movement, exhaust port 26 will reduce the pressure below the piston to atmospheric pressure so that the inlet pressure acting on the upper end of the piston will cause the piston to rapidly move downwardly.

Figure 2:
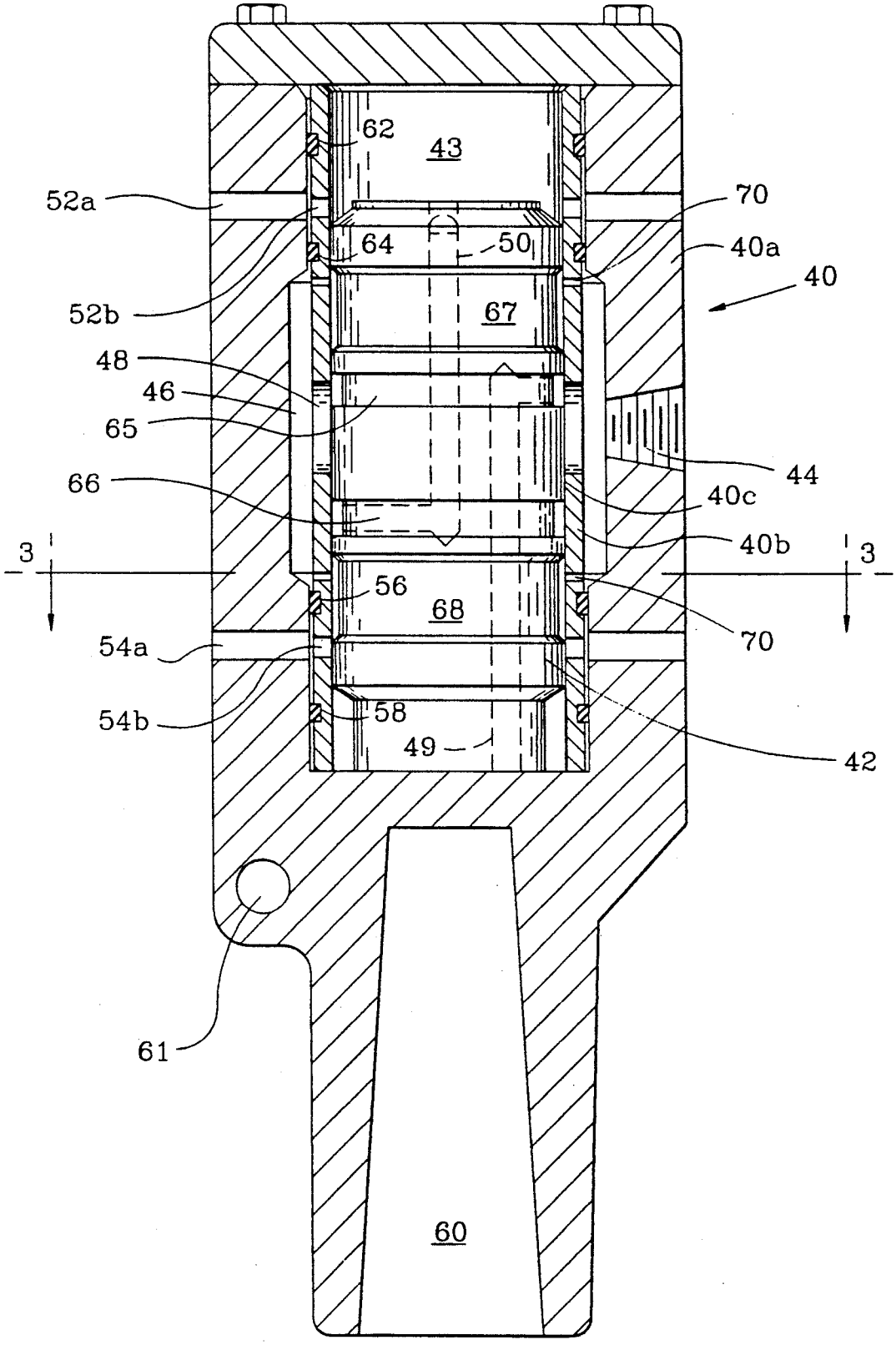
FIG. 2 is an enlarged vertical sectional view of a preferred embodiment of the vibrator of this invention.

In the embodiment of the invention shown in FIG. 2, housing 40 comprises outer cylindrical member 40*a* and inner cylindrical member or sleeve 40*b*. The housing 40*a* may be provided with a tapered hollow recess 60 located at a lower region thereof, and a circular opening 61, to facilitate mounting of the vibrator. Piston 42 is located in bore 43 of the housing and moves relative to inner sleeve member 40*b*. Outer inlet port 44 is connected to a source of air under pressure (not shown) and supplies annular chamber 46 between the outer and inner members of the housing with air under pressure. Inner inlet port 48 supplies air to the inside of the housing to flow through passages 49 and 50 in piston 42 and, in the manner described above, cause the piston to reciprocate in the bore of the housing. Outlet passages 52*a* and 52*b* and 54*a* and 54*b* function in the same manner as described above in connection with outlet passages 24 and 26 of FIG. 1. Since the pressure of the incoming operating air must be maintained in annular chamber 46, two annular seal members 56 and 58 preferably comprised of elastomeric materials are located in spaced-apart annular grooves at a lower region of the sleeve member 40*b*. Similarly, two annular seal members 62 and 64 are located in spaced-apart annular grooves in an upper region of the sleeve member, 40*b*.

One pair of seals is located on each side of inlets 44 and 48. Within each pair then, one seal of each pair is located on each side of outlet 52, and 54 respectively. As such, annular chamber 46 is defined such that it begins axially at a lower annular seal and ends axially at an upper annular seal. The piston 42 has a total of four annular grooves in its outer surface, grooves 65 and 66 being narrower and deeper than grooves 67 and 68 for pressurized air distribution around the piston exterior. The narrower annular grooves 65 and 66 are located nearer the medial region of the piston and the broader grooves 67 and 68 are spaced therefrom nearer the ends of the piston.

Figure 3:
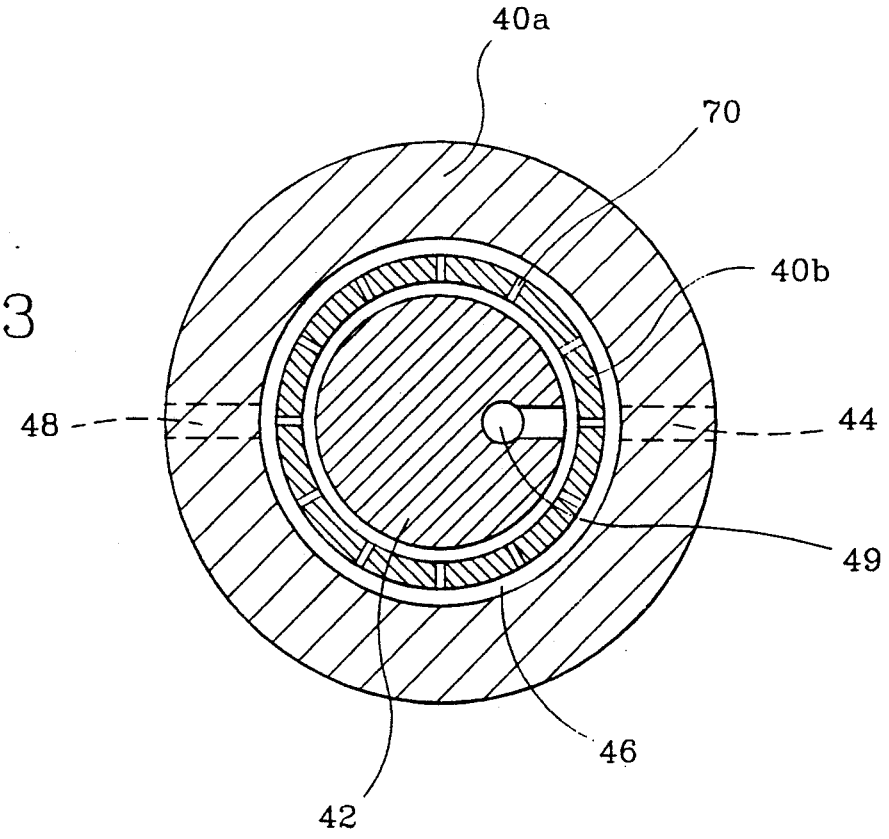
FIG. 3 is a horizontal sectional view taken along line 3—3 of FIG. 2.

An important feature of this invention is the provision of a film of air under pressure between the piston 42 and the inner surface 40*c* of inner sleeve member 40*b* of the housing to reduce the amount of contact between the piston and cylinder as the piston reciprocates in the housing thereby reducing the rate of wear between the piston and the housing. In the embodiment shown, a plurality of nozzle-shaped openings 70 are located in the wall of inner housing member 40*b*, as shown in FIGS. 2 and 3, on both sides of inlet ports 49 and 50. These nozzle-shaped openings are located in a circumferential radial pattern as shown in FIG. 3 so that they will direct a stream of pressurized air into the annular space between the piston and housing as the piston reciprocates in the housing thereby reducing the friction and the wear between the piston and the inner member. An important character of this invention is the provision for providing balanced pressure forces circumferentially around the piston virtually maintaining perfect and uniform clearance between the piston and the bore. This structure provides an air bearing between the piston and inner sleeve of the housing which prevents metal-to-metal contact. Such balanced clearance results in essentially no metal wear from continuous use of the vibrator.

As stated with regard to this embodiment, piston 42 is provided with annular grooves 65, 66, 67 and 68 within which the openings to passageways 49 and 50 are located. These grooves serve the function of single annular groove 22 in the prior art embodiment shown in FIG. 1, i.e. to make certain that pressurized air can flow freely from the inlet ports into the passageways regardless of the orientation of the piston relative to the inlet ports. Also the pressurized air flows through the nozzles 70 to provide an air bearing between the piston and the inner wall of the bore to minimize metal surface wear. The pressurized air is introduced into the vibrator from a single common air source without any external controls. As stated, air from the main port is utilized to provide the fluid bearing and also provide the energy-creating reciprocal motion to the piston within the housing.

Figure 4:
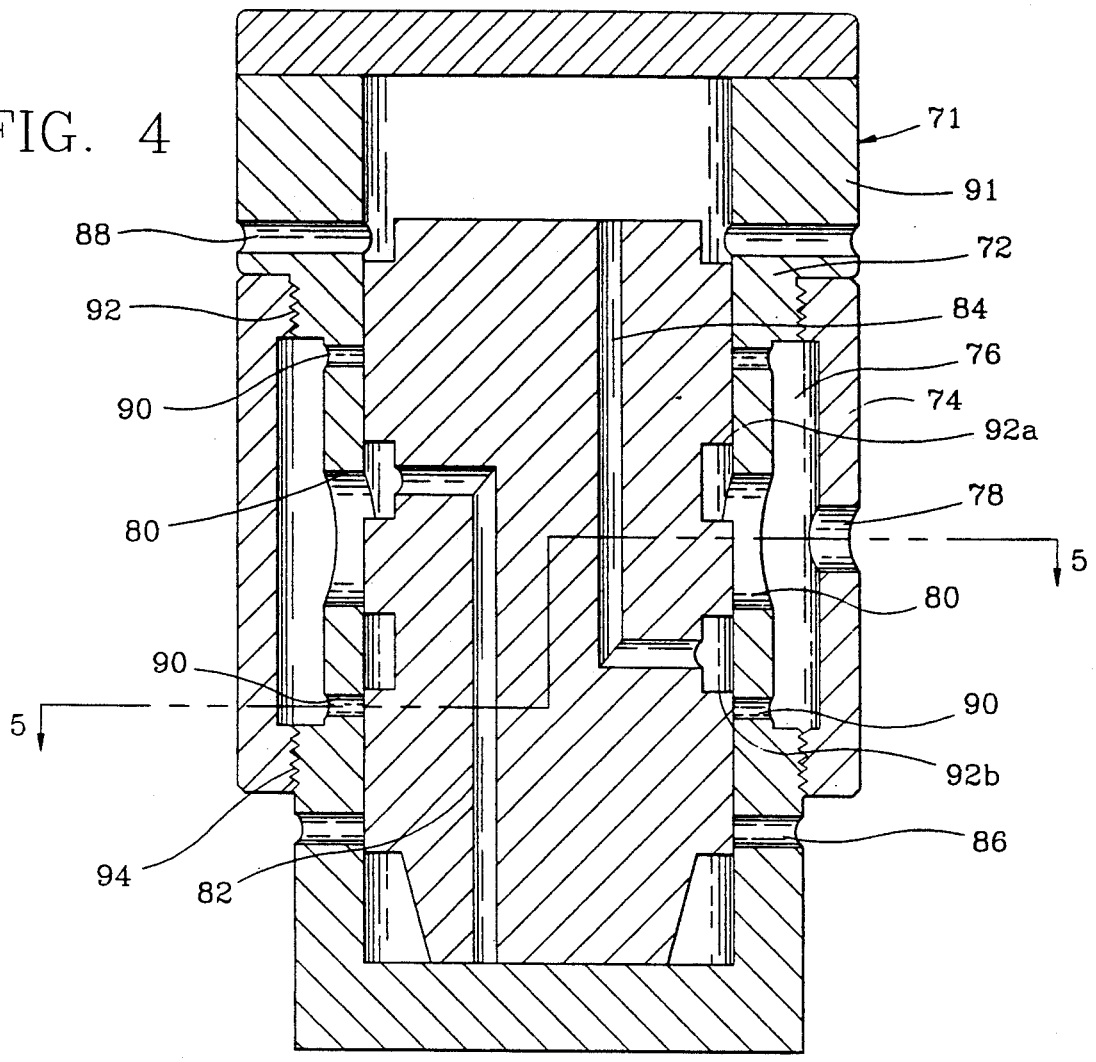
FIG. 4 is a vertical sectional view of an alternate embodiment of the vibrator of this invention.

In the alternate embodiment shown in FIG. 4, the only difference between it and the embodiment shown in FIG. 2 is in the construction of the housing. In this embodiment, housing 71 includes cylindrical member 72 which serves as the inner member and cylindrical outer member 74 which is spaced from a portion of the outer surface of inner member 72 to form annular chamber 76. The chamber has outer inlet 78 and inner inlet 80 that supplies air to passages 82 and 84 to cause the piston 93 to reciprocate in the manner described above. Outlet ports 86 and 88 are located in inner member 72 on opposite sides of outer member 74 so that pressure can be maintained in annular chamber 76. Nozzles 90 located in the wall of inner member 72 in a circumferential radial pattern, adjacent opposite ends of annular chamber 76, provide the air bearing between the piston 93 and the inside surface of housing member 72, in the manner described. The housing 70 at its upper end has an enlarged shoulder or flange 91 which serves as a stop for the threaded outer member 74. The annular grooves 92*a* and 92*b* extend circumferentially around the piston at a medial region as shown in FIG. 4 to lessen the total exterior surface area of the piston and provide improved air flow for the air bearing.

This embodiment is particularly adapted for use in high temperature environments by eliminating annular seal members 56, 58, 62 and 64 of the embodiment of FIG. 2. Such seals would generally be of an elastomeric material which is subject to deterioration at high temperatures. By using labyrinth type seals, such as provided by engaging threads 92 and 94, at opposite ends of outer sleeve member 74, the elastomeric seals can be eliminated. Thus, by forming the threads for a close fit wherein they are essentially straight threads, the threads will provide a labyrinth to restrict the flow of air from the annular chamber though the threads sufficiently to allow the desired pressure to be maintained in the annular chamber for the proper operation of the vibrator. These threads also attach the outer sleeve member of the housing to the inner member.

The subject vibrator provides an internal reservoir of pressurized air which is used to float the reciprocating piston on an air cushion thereby greatly reducing the friction and surface wear between the piston and cylinder. Such construction greatly increases the vibrator service life. In addition, the replaceable inner cylinder member or sleeve allows for relatively easy field repair of the vibrator. Thus, by providing a "fluid-bearing" between the piston and cylinder wall, friction is virtually eliminated in which a "free-floating" piston effect takes place.

Figure 5:
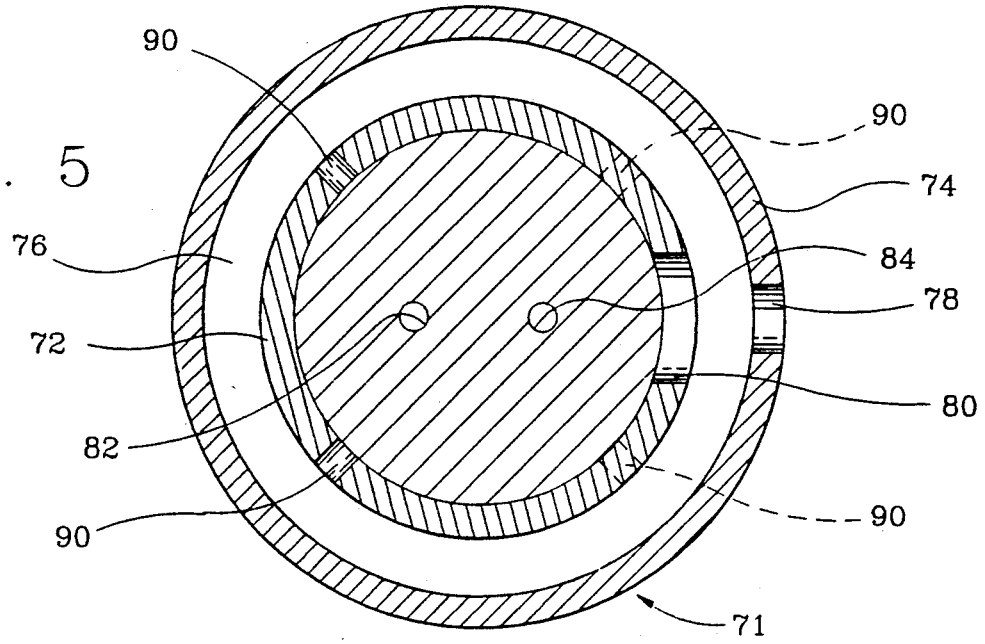
FIG. 5 is an enlarged sectional view taken along line 5—5 of FIG. 4.

The vibrator employing the juxtaposed annular elastomeric seals to close upper and lower portions of the annular air chamber is employed in relatively low temperature applications. In the structure shown in FIGS. 4 and 5 wherein the metallic sleeve is fastened on the housing exterior, such vibrator may be used in high temperature operations of the order of 800° to 1200° F. The air bearing provides a constant uniform air flow around the piston thereby creating a "cooling" effect. This cooling effect significantly reduces thermal expansion of the piston and housing, resulting in an overall reduction in friction on the moving surfaces.

The subject vibrators are frequently operated at air pressure ranging from about 25 to 40 psi depending upon their particular size and operating applications. The units do not need to be lubricated during service life. Thus, the units which include the air bearing principle are not dependent upon lubrication of any kind over long-term service life. The subject vibrator may be used singly or in plural series, as desired or required, depending upon the application. Long-term continuous use such as 3 to 6 months, or longer, in heavy-duty requirements without servicing or replacement is a special advantage.

The subject vibrator operates very satisfactorily at air pressures of about 25 to 30 psi with no lubrication required. It can be operated in a uniform manner without maintenance or lubrication for lengthy continuous operating periods which are 2 to 3 times greater, and possibly longer, than all other conventional vibrators.

Accordingly, the improved vibrator is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved vibrator is constructed and used, the charac-teristics of the construction, and the advantageous, new and useful results obtained; the new and useful structures, devices, elements, arrangements, parts and combinations, are set forth in the appended claims.

We claim:

1. A pneumatic vibrator comprising a tubular housing having closed ends, an inlet port in the housing through which air can flow into the housing, a free-floating piston mounted within the housing having two passageways through which air entering the housing through the inlet port flows to act alternately against opposite ends of the piston and cause the piston to reciprocate within the said housing, exhaust ports in the said housing through which pressurized air ahead of the moving piston is exhausted from the said housing, a plurality of relatively small radial openings in the said housing in a circumferential pattern through which pressurized air flows into the said housing and provides an air bearing between the piston and the housing, two annular grooves formed in the piston which communicate with said relatively small radial openings through substantially the entire stroke of said piston such that air will eventually be forced out of said annular grooves into an annular space between said piston and said housing in a dynamic manner, and a source of pressurized air for simultaneously supplying said inlet port and said small openings with air under pressure.

2. A pneumatic vibrator comprising a tubular housing having closed ends and inner and outer cylindrical walls forming an annular chamber therebetween, a first inlet port in the outer wall of the annular chamber through which air is supplied to the said annular chamber, a second inlet port in the inner wall of the said annular chamber through which air can flow into the housing, a free-floating piston in the said housing having two passageways through which air from the annular space between said walls entering the housing through the second inlet port flows alternately to act alternately against opposite ends of the piston and cause the piston to reciprocate within the said housing, exhaust ports in the said housing through which pressurized air ahead of the moving piston is exhausted from the said housing, and a plurality of relatively small radial openings through the inner wall of the annular chamber in a circumferential pattern through which pressurized air flows into the said annular chamber and provides an air bearing between the said piston and the said annular chamber, and a source of pressurized air for supplying pressurized air to said first and second inlet ports.

3. The pneumatic vibrator of claim 2 in which the annular chamber of said housing comprises an outer cylindrical member and an inner cylindrical member, the outer walls of said inner cylindrical member being inwardly spaced from the inner walls of said outer cylindrical member, and spaced apart sealing means between the inner and outer cylindrical members spaced longitudinally to form said annular chamber between the said cylindrical members.

4. The pneumatic vibrator of claim 3 in which the inner cylindrical member is removable to allow the said inner cylindrical member to be replaced when damaged or worn thereby leaving the tubular housing undamaged.

5. A pneumatic vibrator comprising a cylindrical housing and an inner cylindrical sleeve located within the said housing, said housing and sleeve having a common central axis, means closing the ends of the housing and the sleeve, a portion of said sleeve being spaced from the housing to form an annular chamber between the sleeve and the housing, annular seals spaced axially apart with said annular chamber being located between said seals and between the housing and the sleeve a free-floating piston mounted within the said sleeve for reciprocal movement longitudinally of the sleeve and to form with the end closure means hollow chambers between the ends of the said piston and the said end closure means that alternately increase and decrease in volume as the piston reciprocates, a first pressurized air inlet port in the said housing through which pressurized air is supplied to the said annular chamber, a second pressurized air inlet port in the said sleeve through which pressurized air in the said annular chamber flows into the sleeve, an exhaust port located axially beyond each of said annular seals and said annular chamber and extending through the said sleeve and the said housing to connect the interior of said sleeve to the atmosphere, said exhaust ports being positioned for the flow of pressurized air through the ports to be alternately restricted as the piston reciprocates in the sleeve, and passages within the piston that connect the inlet port of the said sleeve to the said hollow chambers whose exhaust ports are restricted by the said piston to cause said piston to reciprocate, and a plurality of radial nozzles in the said sleeve in a circumferential pattern through which air in the said annular space flows to the inside of the sleeve and provides an air bearing between said piston and said sleeve as the said piston reciprocates relative to the said sleeve.

6. A pneumatic vibrator comprising a tubular housing having closed ends, an inlet port in the housing through which air flows into the housing, a free-floating piston mounted within the housing having two passageways through which air entering the said housing through the said inlet port flows to act alternately against opposite ends of the piston and cause the said piston to reciprocate within the said housing, a source of pressurized air for supplying pressurized air to said inlet port, exhaust ports in the said housing through which pressurized air ahead of the moving piston is exhausted from the said housing, a plurality of relatively small radial openings in the said housing in a circumferential pattern through which pressurized air flows into the said housing and provides an air bearing between said piston and said housing.

7. A pneumatic vibrator in accordance with claim 6, in which the said housing comprises an outer cylindrical member and an inner cylindrical member spaced from the outer member, and spaced-apart sealing means between the inner and outer cylindrical members to form an air-tight annular chamber between said members.

8. A pneumatic vibrator in accordance with claim 7, in which the inner cylindrical member is removable and replaceable when damaged or worn thereby leaving said tubular housing undamaged.

9. A pneumatic vibrator in accordance with claim 7, in which the said cylindrical outer member comprises a cylindrical sleeve attached at opposite ends to the said inner member and having a medial portion spaced from said inner member to form the said air tight annular chamber.

10. A pneumatic vibrator in accordance with claim 7, wherein the said plurality of relatively small radial openings are located in a medial region of said housing extending between said annular chamber and said piston to provide an air bearing for reciprocating movement of said piston.

* * * * *